US006616531B1

(12) United States Patent
Mullins

(10) Patent No.: US 6,616,531 B1
(45) Date of Patent: Sep. 9, 2003

(54) METHOD AND APPARATUS FOR PLAYING ONE GAME AND USING ELEMENTS FROM THE ONE GAME TO PLAY AT LEAST ANOTHER GAME

(76) Inventor: Wayne L. Mullins, 2937 E. Nisbet Ct., Phoenix, AZ (US) 85032

( * ) Notice: Subject to any disclaimer, the term of this patent is extended or adjusted under 35 U.S.C. 154(b) by 0 days.

(21) Appl. No.: 09/258,669

(22) Filed: Feb. 26, 1999

Related U.S. Application Data

(63) Continuation-in-part of application No. 09/139,459, filed on Aug. 25, 1998, now Pat. No. 6,210,276.

(51) Int. Cl.[7] ..... A63F 9/24

(52) U.S. Cl. ..... 463/19; 273/269

(58) Field of Search ..... 463/27, 16–20, 463/28, 39–42; 273/269, 138.1, 138.2, 292

(56) References Cited

U.S. PATENT DOCUMENTS 5,158,293 A 10/1992 Mullins ..... 273/139

*Primary Examiner*—Michael O'Neill

(57) ABSTRACT

Method and apparatus for playing one game and using elements from the one game to play at least another game. One game may be a lottery ticket game 11A and at least another game may be a symbol collection game 21A. Lottery ticket game 11A involves defining and using various symbols. Symbol collection game 21A involves using and collecting at least some of the symbols from lottery ticket game 11A. Game 5C comprises a TRILOGY BINGO lottery ticket game 11B and a TRILOGY BINGO letters collection game 21B. One of the letters of TRILOGY or other word or symbols is collected by collecting all of the BINGO letters 65 or one of the wild symbols from lottery ticket game 11B. A jackpot is won by collecting all TRILOGY letters or such and calling out a win notification or activating a button. The jackpot is won by only one winning player or split among other winning players. Game 5C also allows players to wager for a table jackpot among other players as to certain elements 13B being collected after a play of the lottery ticket game 11B. Game 5C may be played electronically in entirety. Table 70 having a plurality of table player stations 72 are used in conjunction with the game 5C. Table player stations 72 are linked together at a table, house, or network level. Table player stations 72 each have indicator lights to light up respective symbol images as the symbols are collected from the lottery tickets 60.

36 Claims, 8 Drawing Sheets

METHOD AND APPARATUS FOR PLAYING ONE GAME AND USING ELEMENTS FROM THE ONE GAME TO PLAY AT LEAST ANOTHER GAME

This application is a continuation-in-part application of U.S. patent application Ser. No. 09/139,459 filed by inventor Wayne L. Mullins on Aug. 25, 1998, now U.S. Pat. No. 6,210,276, issued on Apr. 3, 2001.

FIELD OF INVENTION

The present invention relates to playing a game and at least another game, and, in particular, to a method and apparatus for playing one game and using elements from the one game to play at least another game.

BACKGROUND OF INVENTION AND BRIEF DESCRIPTION OF THE PRIOR ART

Games in general typically provide a limited number of ways and incentives to play and win. There is a need to continually develop games that provide additional plays, win opportunities, and incentives for the players to make the game or games more fun and exciting.

A number of games and gaming apparatuses and methods exist in the prior art. Various games of skill or chance are used in casinos, gambling halls and by state lotteries. One of these games of skill or chance involve lottery tickets in which a person purchases a lottery ticket in hoping that he/she will win an instant amount or a jackpot amount. Another game of skill or chance is the popular BINGO game. BINGO card or cards are purchased by a player. A caller calls BINGO numbers, and the player hopes to cover the card or cards in the desired pattern and further hopes to be one of the first potential winner(s) to call out "BINGO".

Lottery tickets that provide instant jackpot wins and lottery tickets that provide progressive jackpot wins are well known in the art. In fact, lottery tickets that combine the potential for a player to win an instant jackpot(s) and a progressive jackpot(s) have been developed to further provide play, incentive, fun, excitement, etc. to the players. U.S. Pat. No. 5,158,293 to Mullins ("Mullins") discloses an example of such a combination lottery ticket and game. Therefore, there is a continued need and desire to provide a lottery ticket game or such other game that provides further play, incentive, fun, excitement, etc. to the players. Also, there is a need and desire to provide a lottery ticket game or such other game with additional win opportunities based on relatively easy games, especially the opportunities to win jackpots. Play of the game would therefore be further driven by the additional play, win opportunities, incentives, fun, excitement, etc. Without additional win opportunities and incentives, players may become bored and lose interest with the lottery ticket game.

Typically, BINGO cards are simply purchased by players, and the players respectively play the cards. The BINGO game is a relatively easy game that is well known and is able to be played by a number of people. The cards, in themselves, have no potential inherent or win value until the cards are played for the respective BINGO game. The BINGO game is won after a number of BINGO numbers are called. Players have to patiently wait after various BINGO numbers are called until a possible win situation occurs for his/her cards. Those cards that do not reflect a win situation after a calling round of BINGO are useless and valueless to the player and are typically not kept by the player and discarded. The BINGO game does not provide further incentives or win possibilities, such as instant jackpot wins in lottery ticket games, simply based on the purchase of the cards themselves. Therefore, there is a need and desire to integrate the simple general concepts of the BINGO game into other games. There is also a need and desire to generally take the BINGO card concept in providing further win opportunities for players. Without additional win opportunities and incentives, players may become bored and lose interest with the BINGO game. Also, since calling numbers for a BINGO game may be very laborious and time consuming, there is a need and desire to reduce or eliminate the actual calling of BINGO numbers.

The need of providing additional win opportunities and incentives for play of a game continually exists. The need exists for continually providing additional win opportunities and incentives for a lottery ticket game and/or a BINGO game. Therefore, the present invention discloses and provides a method and apparatus for playing one game and using elements from the one game to play at least another game, and the present invention overcomes the problems, disadvantages, and limitations of the prior art.

SUMMARY OF INVENTION

Set forth is a brief summary of the invention in order to solve the foregoing problems and achieve the foregoing and other objects, benefits, and advantages in accordance with the purposes of the present invention as embodied and broadly described herein.

It is an object of the invention to provide the ability to play one game and use elements from the one game to play at least another game.

It is another object of the invention to provide the ability to play one game of chance or skill and use elements from the one game of chance or skill to play at least another game.

It is a further object of the invention to provide a number of or additional ways and incentives to play and win a game.

It is still a further object of the invention to provide games that have additional plays, win opportunities, and incentives for the players.

It is still another object of the invention to provide games that provide more fun and excitement to players.

It is another object of the invention to enhance the general concepts, rules, and limitations of a lottery ticket game and expand the play and win opportunities of the lottery ticket game.

It is a further object of the invention to incorporate the general concepts, rules, and limitations of a BINGO game into another game, particularly a lottery ticket game and lottery electronic ticketless game.

The above objects and advantages of the invention are achieved by a method for playing one game and using elements from the one game to play at least another game. Rules and the elements for the one game are defined. The elements for the one game are provided and used, and the one game is played. Rules for at least another game are defined, and at least some of the elements from the one game to play the at least another game are provided and used. The other game(s) is played. The one game and at least another game may be games of chance or skill. The one game may be a lottery ticket game or lottery electronic ticketless game and the at least another game may be a symbol collection game.

The lottery ticket game involves defining symbols for the lottery ticket game, printing the symbols on lottery tickets for the lottery ticket game, and using the symbols to define winning indices for the lottery tickets. The symbol collection game involves using and collecting at least some of the symbols from the lottery ticket game to play the symbol collection game. In particular, BINGO letters and wild symbols may be collected by playing a play of the lottery ticket game. The symbol collection game may further involve collecting and spelling letters or words such as the word TRILOGY. One of the letters of TRILOGY may be collected by collecting all of the BINGO letters from plays of the lottery ticket game. One of the letters of TRILOGY may also be collected by obtaining one of the wild symbols from plays of the lottery ticket game. A jackpot for the symbol collection game is won by collecting all of the letters of TRILOGY. A player may have to call out a win notification when a player has collected all of the letters of TRILOGY in order to win. The game may be set up such that the jackpot is won by only one winning player or split among other winning players. The jackpot may be a fixed prize or a progressive jackpot and may be determined based on sales of the lottery tickets from the lottery ticket game. The game may also be set up where players wager for a table jackpot among other players as to certain elements being collected from the lottery ticket game (i.e. one or more or all of the BINGO letters being collected) after a play of the lottery ticket game or other indices printed on the ticket. The game may also be set up to be played electronically in entirety.

The above objects and advantages of the invention are also achieved by a method for playing one game and using elements from the one game to play at least another game. Symbols are used as the elements to define wins for the one game. The symbols are provided and used to play the one game, and the one game is played. At least some of the symbols are used from the one game to play the at least another game, and the at least another game is played. The one game is a lottery ticket game or lottery electronic ticketless game, and the at least another game is a symbol collection game. The lottery ticket game involves printing the symbols on lottery tickets for the lottery ticket game and using the symbols to define wins for the lottery tickets. The lottery electronic ticketless game involves defining symbols shown on an electronic ticket or displayed on a monitor and using the symbols to define wins for the lottery electronic ticketless game. The symbol collection game involves using and collecting at least some of the symbols from the lottery ticket game or lottery electronic ticketless game to play the symbol collection game.

The above objects and advantages of the invention are further achieved by a lottery ticket game and letters collection game. These games have lottery tickets having defined play symbols, various winning combinations, and at least one letters collection combination. The defined play symbols include at least symbols to be collected for the letters collection game. The various winning combinations of the play symbols are printed for the lottery ticket game or displayed for the lottery electronic ticketless game. The at least one letters collection combination are obtained from the symbols and is defined as at least one winning situation for the letters collection game. The various winning combinations may be at least a combination of BINGO or other BINGO related game letters. The at least one winning situation may be the collection of all letters for TRILOGY. One of the letters for TRILOGY may be obtained and collected when all letters for BINGO have been collected from at least one of the lottery tickets or lottery displays. Also, one of the letters for TRILOGY may be obtained and collected when a wild symbol has been collected from at least one of the lottery tickets.

These games may include the use of a table. The table has a plurality of table player stations. The table player stations each have indicator lights to light up respective symbol images as the symbols are collected from the lottery tickets. The table player stations are linked to a table computer. A number of table computers may be linked together to a house computer in a house if play is to be set up at a house game prize level. A number of house computers may be linked together to a network if the play is to be set up as a network game prize level. A number of house computers may be linked together to a network computer in a network. The computers control and manage play of the game.

The above objects and advantages of the invention are also achieved by a method of playing a lottery ticket game and letters collection game. Players purchase and play tickets for the lottery ticket game. It is determined whether the players have won the lottery ticket game, and the player(s) win respective amounts for the lottery ticket game. The players that desire to play the letters collection game are determined. Play for the players that desire to discontinue play of the games is discontinued, and play for the players that desire to continue play of the lottery ticket game is continued. It is determined whether the players that desire to play the letters collection game have elements on the tickets that are usable for the letters collection game. Play of the letters collection game for the players that have the elements on the tickets is continued. It is determined whether the players that do not have the elements on the tickets desire to continue play of the games, and the players continue respective play of the games for the players that desire to continue. It is determined whether at least one of the players has collected a sufficient number of the elements to have all necessary letters to win the letters collection game, and play of the games ends by having the at least one of the players that has collected all necessary letters to call out a win notification.

The preferred embodiments of the inventions are described below in the Figures and Detailed Description. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Detailed Description is not intended to indicate a desire to invoke the special provisions of 35 U.S.C. Section 112, paragraph 6 to define the invention. To the contrary, if the provisions of 35 U.S.C. Section 112, paragraph 6, are sought to be invoked to define the inventions, the claims will specifically state the phrases "means for" or "step for" and a function, without also reciting in such phrases any structure, material, or act in support of the function. Even when the claims recite a "means for" or "step for" performing a function, if they also recite any structure, material or acts in support of that means of step, then the intention is not to invoke the provisions of 35 U.S.C. Section 112, paragraph 6. Moreover, even if the provisions of 35 U.S.C. Section 112, paragraph 6, are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function.

DETAILED DESCRIPTION

Figure 1:
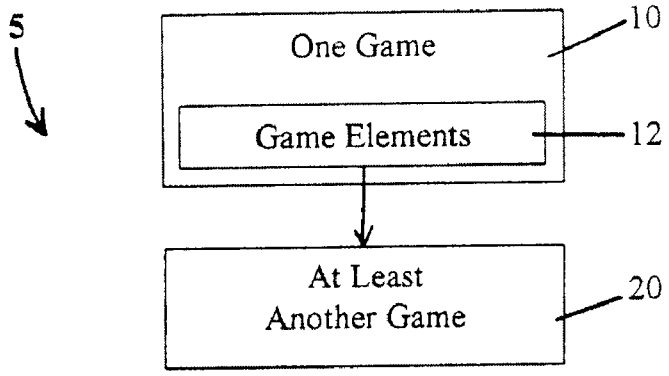
FIG. 1 is a block diagram of the general concept for a game and at least another game of the present invention.

The present invention is an apparatus and method for playing one game and using elements from the one game to play at least another game. FIG. 1 shows the general concept for the present invention game 5. The present invention game 5 involves playing the one game 10 and using the elements 12 from the one game 10 to play at least another game 20. Game 5 involves defining the rules and the elements 12 for the one game 10. The elements 12 are provided and used for the one game 10, and the one game 10 is played by the player or players. Game 5 also involves defining rules for at least another game 20. At least some of the elements 12 from the one game 10 are used to play the other game(s) 20, and the other game(s) 20 are accordingly played by the player or players.

Figure 2:
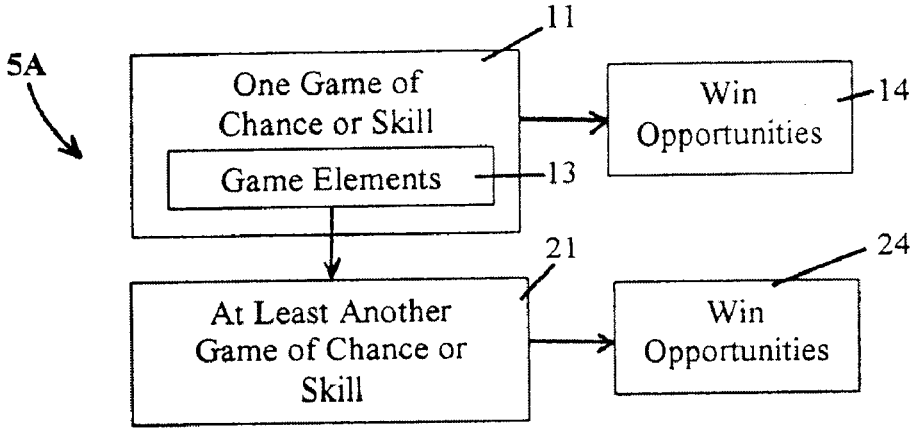
FIG. 2 is a block diagram of the general concept for a game of chance or skill and at least another game of chance or skill with respective win opportunities of the present invention.

FIG. 2 shows an example embodiment 5A of the present invention that may involve the apparatus and method for playing one game of chance or skill 11 and using elements 13 from the one game of chance or skill 11 to play at least another game of chance or skill 21. FIG. 2 shows the general concept for this embodiment of the present invention. Rules and elements 13 are defined for the one game of chance or skill 11. The elements 13 are provided and used for the one game of chance or skill 11, and the one game of chance or skill 11 is played by the player or players. This game embodiment 5A also involves defining rules for at least another game of chance or skill 21. At least some of the elements 13 from the one game of chance or skill 11 are used to play the other game(s) of chance or skill 21, and the other game(s) of chance or skill 21 are accordingly played by the player or players. FIG. 2 shows that the games of chance or skill 11 and 21 have respective defined win opportunities 14 and 24. The defined win opportunities 14 and 24 include but are not in any way limited to jackpots, such as instant win amounts, table win amounts, and progressive win amounts. The game embodiment 5 or 5A, therefore, provides additional plays, win opportunities, and incentives for the players by at least using elements 12 or 13 of the one game 10 or 11 in at least another game 20 or 21.

Figure 3:
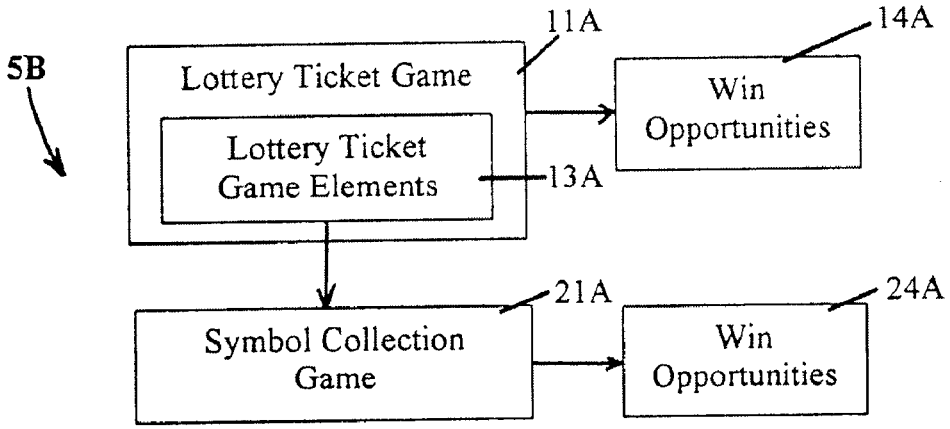
FIG. 3 is a block diagram of the general concept for a lottery ticket game and a symbol collection game with respective win opportunities of the present invention.

FIG. 3 shows an example game 5B of the present invention wherein the one game of chance or skill 11 is a lottery ticket game 11A and wherein the other game of chance or skill 21 is a symbol collection game 21A. The lottery ticket game 11A has defined win opportunities 14A, and the symbol collection game 21A has defined win opportunities 24A. At least some of the elements 13A from the lottery ticket game 11A are used to play the symbol collection game(s) 21A. The lottery ticket game 11A and the symbol collection game(s) 21A are accordingly played by the player or players based on their defined rules and win opportunities 14A and 24A. Therefore, the use of elements 13A from the lottery ticket game 11A in the symbol collection game 21A provides additional plays, win opportunities, incentives, fun, and excitement for the players. Alternatively, the one game of chance or skill 11 may be a lottery electronic ticketless game that involves defining symbols shown on an electronic ticket or displayed on a monitor and using the symbols to define wins for the electronic ticketless game.

Figure 4:
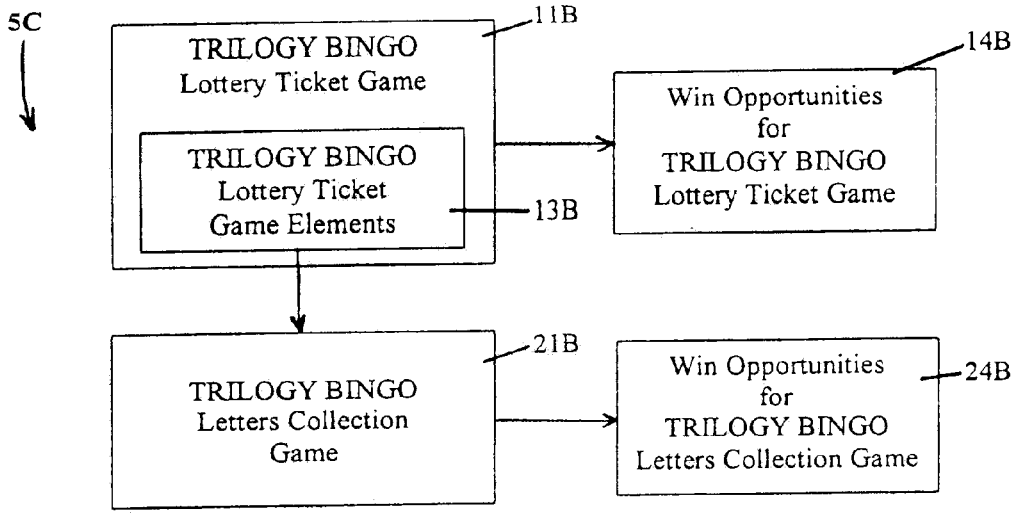
FIG. 4 is a block diagram of the general concept for the TRILOGY BINGO lottery ticket game and the TRILOGY BINGO letters collection game with respective win opportunities of the present invention.

FIG. 4 shows a specific TRILOGY BINGO game 5C. TRILOGY BINGO is hereafter abbreviated as "TB" for the remaining part of the specification. The lottery ticket game 11A is defined as a TB lottery ticket game 11B, and the symbol collection game 21A is defined as a TB letters collection game 21B. The TB lottery ticket game 11B has defined win opportunities 14B, and the TB letters collection game 21B has defined win opportunities 24B. At least some of the elements 13B from the TB lottery ticket game 11B are used to play the TB letters collection game 21B. The TB lottery ticket game 11B and the TB letters collection game 21B are accordingly played by the player or players based on their defined rules and win opportunities 14B and 24B, which will be discussed in further detail later in the specification. The use of elements 13B from the TB lottery ticket game 11B in the TB letters collection game 21B provides additional plays, win opportunities, incentives, fun, and excitement for the players.

Figure 5:
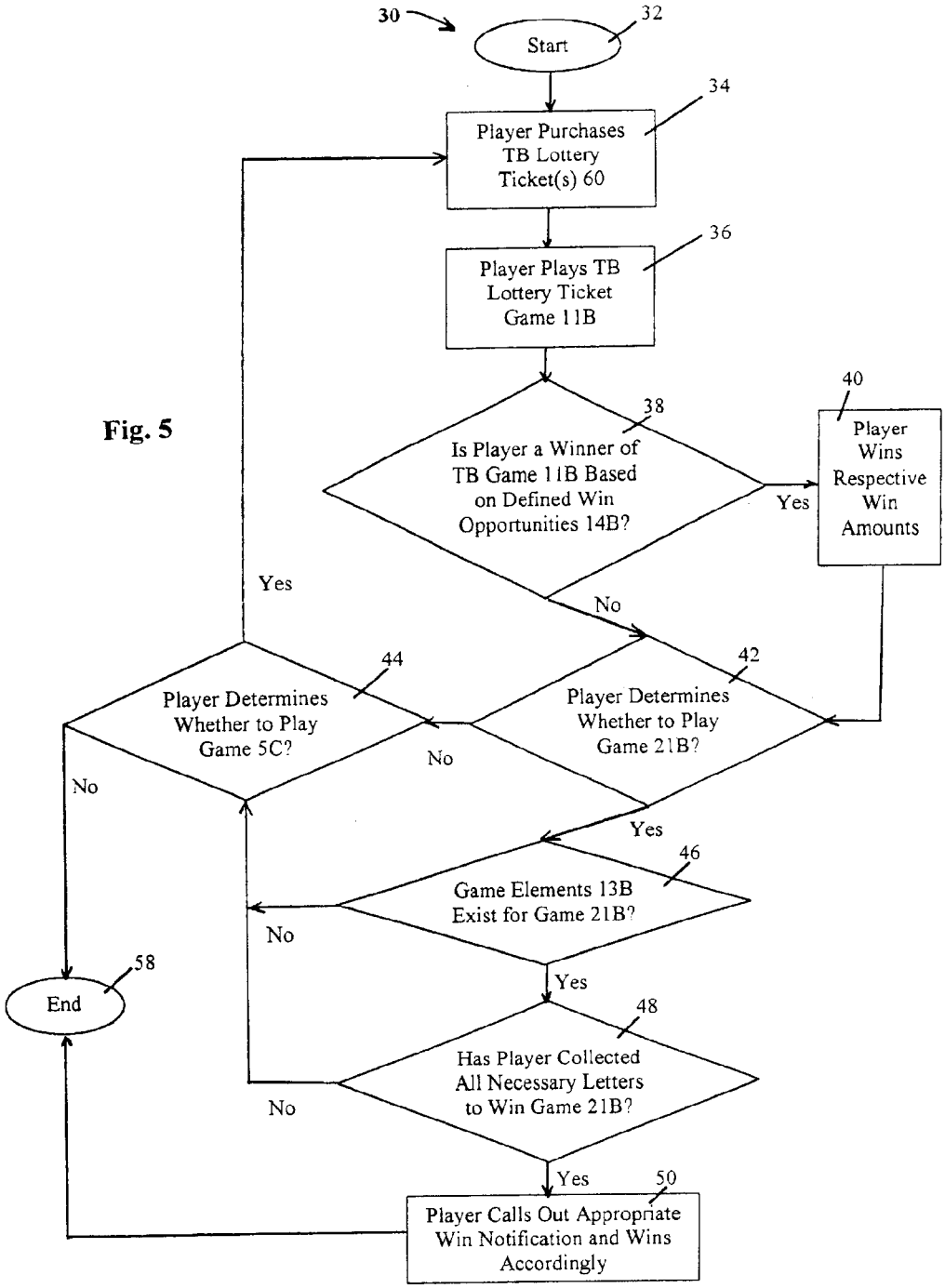
FIG. 5 is a flow chart algorithm of the manner of play of the present invention TRILOGY BINGO game.
Figure 8:
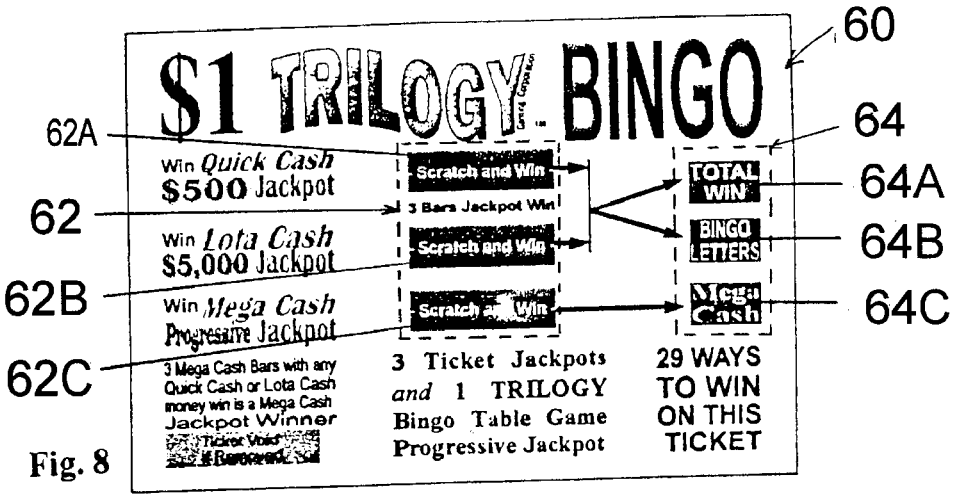
FIG. 8 is a covered playing side of a TRILOGY BINGO lottery ticket for the TRILOGY BINGO lottery ticket game.
Figure 9:
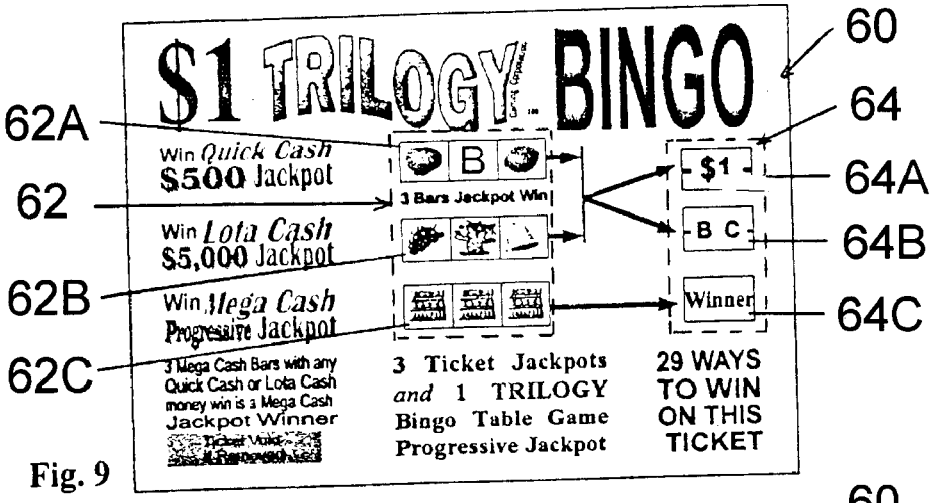
FIG. 9 is an uncovered playing side of a TRILOGY BINGO lottery ticket for the TRILOGY BINGO lottery ticket game.

FIG. 5 shows a general flow chart algorithm 30 of the manner of play for the TB game 5C. Algorithm 30 illustrates a round of play of game 5C. The flow chart algorithm 30 starts at block 32. A player purchases one or more TB lottery ticket(s) 60 (i.e. shown in FIGS. 8 to 10) at block 34. The player plays the ticket(s) 60 by revealing (i.e. scratching off removable covering material, pulling covering tabs, removing black latex security covering, etc.) the hidden play area(s) 62 for various plays of the TB lottery ticket game 11B at block 36 (i.e. FIG. 8 shows an example of a covered ticket 60 while FIG. 9 shows an example of a revealed ticket 60). Also, a scanning device may be able to read a bar code on the ticket 60 to display the hidden play on a display. At block 38, it is determined whether the player is a winner for any of the plays of the TB lottery ticket game 11B based on the defined wins for the respective win opportunities 14B. If the player is a winner of any of the plays of the TB lottery ticket game 11B, then the player wins the respective amount (s) at block 40, and the algorithm 30 then moves to block 42. On the other hand, if the player is not a winner of any of the plays of the TB lottery ticket game 11B, then the algorithm 30 directly moves to block 42.

At block 42, the player determines whether to play the TB letters collection game 21B. If the player decides not to play game 21B, then the player decides whether to continue play of the game 5C altogether at block 44. If the player wishes to continue game 5C, then the algorithm 30 loops back to block 34 where the player continues play by purchasing additional ticket(s) 60. If the player does not wish to continue game 5C, then the algorithm 30 ends at block 58.

On the other hand, if the player decides to play the TB letters collection game 21B at block 42, then it is determined whether any of the game elements 13B for the TB lottery ticket game 11B are symbols that are able to be used for the TB letters collection game 21B at block 46. If no game elements 13B exist for the game 21B, then the player decides to continue to play the game 5C at block 44 and respectively continues or discontinues play of game 5C. However, if game elements 13B exist for the game 21B at block 46, then it is determined whether the player has collected all necessary letters to win the game 21B at block 48. If the player has collected all of the necessary letters to win game 21B at block 48, then the player appropriately calls out that he/she has won at block 50 and wins, and the game 5C ends at block 58. If the player has not collected all of the necessary letters to win game 21B at block 48, then the algorithm 30 moves to block 44 to determine whether the player will continue to play the game 5C at block 44 and respectively continues or discontinues play of game 5C. The game 5C is typically played by a number of players playing against each other at one or more game table(s) 70 (i.e. shown in FIG. 11) in determining the first player(s) to collect all of the necessary letters to win the game 21B for the certain round of game play according to the algorithm 30.

Figure 6:
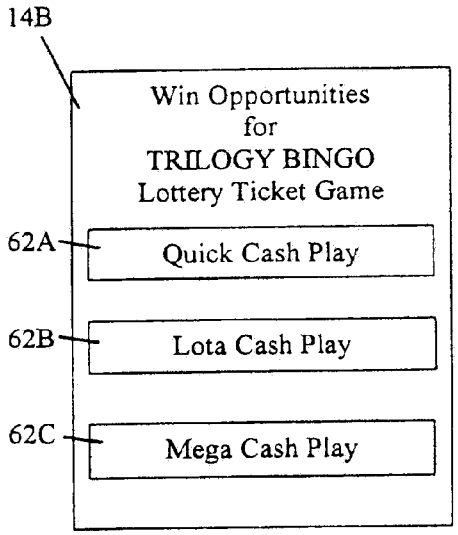
FIG. 6 is a more specific block diagram showing the win opportunities for the TRILOGY BINGO lottery ticket game.

Referring to FIGS. 6 and 8 to 10, details of the TB lottery ticket game 11B are now described. FIG. 8 shows a covered playing side of a TB lottery ticket 60 while FIG. 9 shows a revealed playing side of the TB lottery ticket 60. The ticket 60 has a play area(s) 62 and a receive area(s) 64. Referring to FIGS. 6, 8, and 9, the play area 62 has three different games or win opportunities 14B to be played by the player: a Quick Cash Play 62A, a Lota Cash Play 62B, and a Mega Cash Play 62C.

Figure 10:
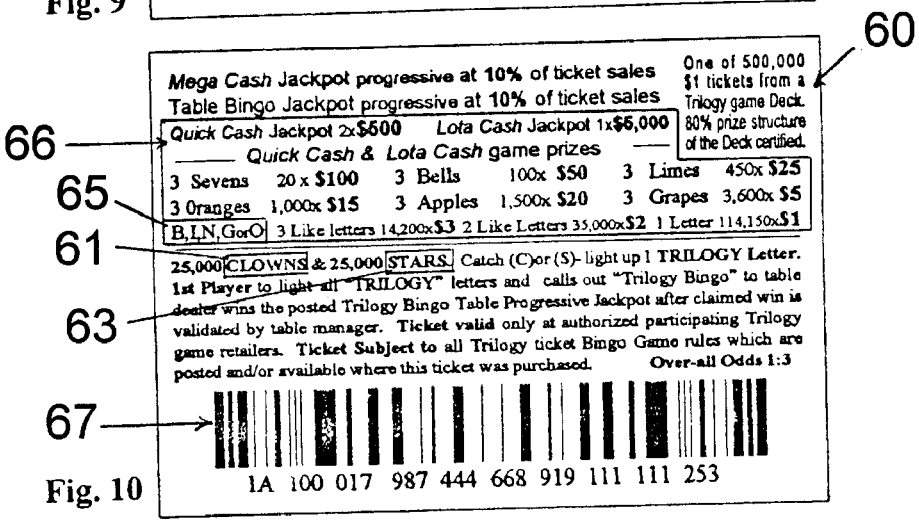
FIG. 10 is a back side of a TRILOGY BINGO lottery ticket for the TRILOGY BINGO lottery ticket game.

FIG. 10 shows the back side of the TB lottery ticket 60. The back side has an area 66 that shows an example of the different winning combinations or winning indices for the Quick Cash Play 62A and Lota Cash Play 62B. The example winning combinations/indices and the number of times that combination is printed or occurs for these two games out of a deck of five hundred thousand tickets 60, indicated in parentheses, may be defined and shown as follows: one B-I-N-G-O letter wins $1 (114,150 times); two like B-I-N-G-O letters wins $2 (35,000 times); three like B-I-N-G-O letters wins $3 (14,200 times); three grapes wins $5 (3,600 times); three apples wins $20 (1,500 times); three oranges wins $15 (1,000 times); three limes wins $25 (450 times); three bells wins $50 (100 times); three sevens wins $100 (20 times); three bars for Quick Cash Play 62A wins a $500 fixed jackpot (2 times); three bars for Lota Cash Play 62B wins a $5000 fixed jackpot (1 time). Therefore, if a player obtains a ticket 60 with any of the above winning combinations/indices for these two games at their respective play lines, then the player wins the respective defined amounts. Referring to FIG. 10, the back side of the TB lottery ticket 60 also has a bar code 67. The bar code 67 is readable by a reader into a computer 92 (i.e. shown in FIG. 11), and the bar code 67 has relevant information such as win indices/combinations, elements, win amounts, verifying information, deck and deal information, and other such pertinent information.

The Mega Cash Play 62C is a progressive or fixed jackpot play. Referring to FIG. 9, the Mega Cash Play 62C is won by a player when three (3) Mega Cash Bars or other designated symbols appear in the Mega Cash play line and when a winning combination from either the Quick Cash Play 62A or Lota Cash Play 62B also appears on a ticket 60. The progressive jackpot is started at an initial value and continues to progress in value based on a percentage or amount of total sales of tickets 60 until the progressive jackpot is won. The example in FIG. 10 shows that the progressive jackpot for the Mega Cash Play 62C continues to progress based on ten percent (10%) of total sales of tickets 60. If the progressive jackpot is won by a player or players, then the progressive jackpot is reset to the initial value.

Referring to FIGS. 8 and 9, the receive area(s) 64 shows the player what he/she has received after playing the ticket 60. FIG. 8 shows a covered receive area(s) 64 while FIG. 9 shows a revealed receive area(s) 64. Area 64A shows the total win amount for both the Quick Cash Play 62A and Lota Cash Play 62B. In the example, FIG. 9 shows that the area 64A reflects a total win of $1 for both the Quick Cash Play 62A and Lota Cash Play 62B. Area 64B shows elements 13B (i.e. letters or symbols) received from the play of the TB lottery ticket game 11B wherein these elements 13B (i.e. letters or symbols) are to be used for the TB letters collection game 21B. In the example, FIG. 9 shows that the BINGO letter "B" and a letter "C", which symbolizes a wild clown symbol, have been received by the player after playing the ticket 60. The letters "B" and symbol "C" are used for play in the TB letters collection game 21B. Area 64C shows whether the player has won the Mega Cash Play 62C. In the example, FIG. 9 shows that the player is a winner of the Mega Cash Play 62C.

A predetermined number of tickets 60 are printed to form a "deck". Two or more decks make up a "deal". Each deck contains a finite number of randomly generated numbers and symbols containing all winners and losers, all prize pay-outs including Quick Cash, Lota Cash, Mega Cash, and TB jackpot allocations. Jackpot allocation amounts and all ticket winners and losers for each game deck is predetermined and set before printing each deck and deal. Winning tickets 60 are verified for the TB lottery ticket game 11B by a host computer. The host computer rescans the winning ticket 60 to verify that ticket sale was recorded and activated at a retailer location, that the ticket 60 holds a win, and that ticket 60 has not been altered. The host computer controls all ticket sales, provides accounting information, and instantly sends jackpot information to respective retailers.

Figure 7:
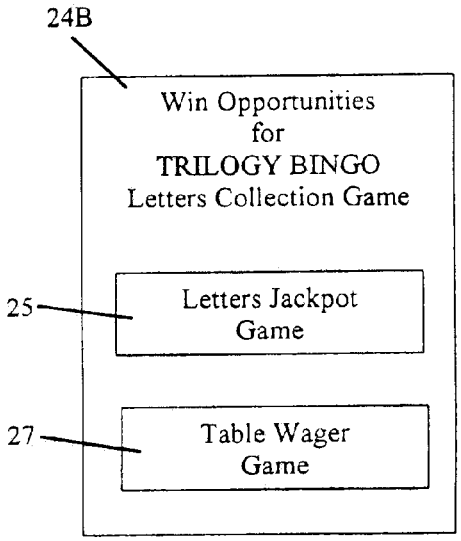
FIG. 7 is a more specific block diagram showing the win opportunities for the TRILOGY BINGO letters collection game.
Figure 11:
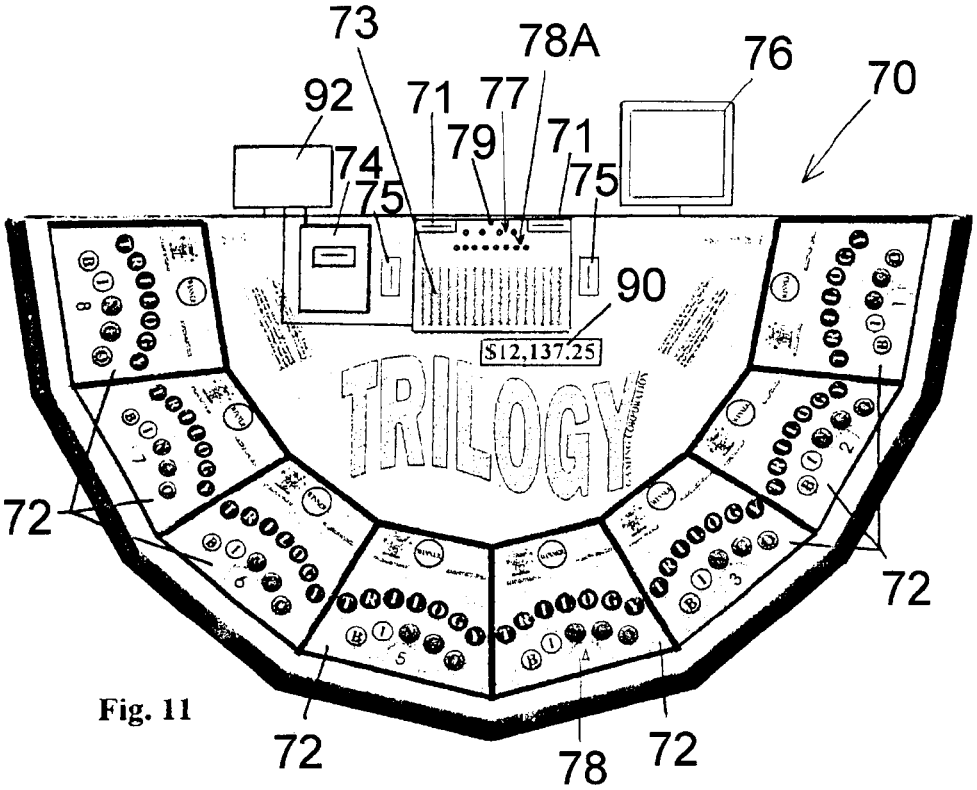
FIG. 11 is a top view of a first embodiment table for the present invention TRILOGY BINGO game.
Figure 12:
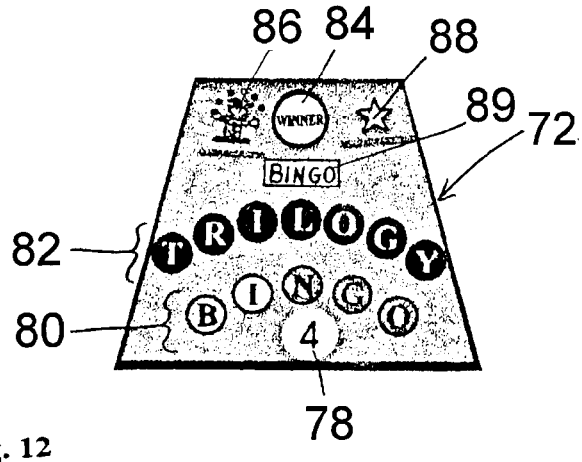
FIG. 12 is a top enlarged view of a table player station which is at the table shown in FIG. 11.

Referring to FIGS. 7 and 11 to 12, details of the TB letters collection game 21B are now described. FIG. 11 shows a table 70 for play of the TRILOGY BINGO game 5C, particularly for the TB letters collection game 21B among a number of players. The table 70 comprises a ticket dispenser/reader 71, a number of table player stations 72, a dealer chip tray 73, a ticket validation and win drop box 74, a cash drop box 75, a dealer monitor 76, ticket purchase buttons 77, player station buttons 78A, and a win lock and reset button 79. The dispenser/reader 71 dispenses each ticket 60 and reads the bar code 67 printed thereon. Each player station 72 provides a play area for each player. The dealer chip tray 73 holds and organizes the playing chips for that table 70. The ticket validation and win drop box 74 receives and reads alleged winning tickets 60 and validates and records the winning tickets 60 and invalidates the nonwinning tickets 60. The cash drop box 75 holds monies received from the players. The dealer monitor 76 allows the dealer to view and monitor play at all player stations 72 and the overall game. The ticket purchase buttons 77 are depressed by the dealer to dispense tickets for the players. The ticket purchase buttons 77 may be configured to dispense one or more tickets at a time for a single depression (i.e. one button 77 may be defined as a single $1 ticket purchase button dispensing $1 tickets one at a time for a single depression and another button 77 may be defined as a $5 ticket purchase button dispensing either five $1 tickets at a time for a single depression or a single $5 ticket at a time for a single depression). The player station buttons 78A are respectively depressed by the dealer to activate and deactivate player stations 72 for registering the player and dispensing tickets 60 for that player. The win lock and reset button 79 is depressed by the dealer when a win occurs to record a win and/or lock the system and to reset a winning player station 72 or all player stations 72 depending on how the game is configured.

Tickets 60 are dispensed from the ticket dispenser/reader 71 that is coupled to or located near the table 70. A dealer is able to stand behind the table 70 to face the various players at the table player stations 72. The monitor 76 is located at or near the table 70 so that the dealer is able to view and monitor the play of the TB lottery ticket game 11B and the TB letters collection game 21B by the various players. The table 70 may also have a display 90 to show the present amount of the progressive jackpot(s) for the TB lottery ticket game 11B and/or the TB letters collection game 21B. A separate overhead monitor (i.e. not shown) may also be used in conjunction with the table(s) 70 to display pertinent player and game information. A computer 92 is also coupled to the table 70 for controlling and monitoring play of the various players at the table 70.

Referring to FIG. 12, each of the table player stations 72 have a player identification number 78 (i.e. FIG. 12 shows that the player station 72 is for player number 4), B-I-N-G-O indicator lights 80, and T-R-I-L-O-G-Y indicator lights 82. The player station 72 may also have a winner indicator light 84, and wild symbol indicator lights such as a clown symbol indicator light 86 and a star symbol indicator light 88 and a wild "BINGO" letters symbol 89. The monitor 76 may reflect the play status of each of the player stations 72 at the table 70. For example, the monitor 76 may be a video image of the table 72 showing the status of the various indicator lights. The monitor 76 may also reflect play of other tables 70, especially if all of the tables 70 are electronically linked together. The monitor 76 may show other pertinent play information for the games 11B and 21B.

The present game 5C is played by the player or players entering the game and purchasing ticket(s) 60 for the TB lottery ticket game 11B at the table 70. When the player or players purchase the tickets 60, the tickets 60 are scanned and dispensed by the dispenser/reader 71 and the host computer 92 registers the tickets 60 as live and activated tickets 60. The tickets 60 may be dispensed by a dealer or automatically by a dispensing machine. Various denominations of the tickets 60 may be provided and dispensed from respective dispensing areas. The player or players use the ticket(s) 60 to play the TB lottery ticket game 11B according to the manner as described earlier. Elements 13B (i.e. letters or symbols) are received by the player or players from the play of the TB lottery ticket game 11B. These elements 13B are collected by the player or players and used for the TB letters collection game 21B.

The main objective of the TB letters collection game 21B is to ultimately collect the necessary elements 13B, such as letters and/or symbols, to obtain the word TRILOGY or other words. Letters for the word TRILOGY or other words are obtained by either of the following scenarios: 1) if a player collects all of the letters for the word BINGO from the ticket(s) 60, then that player receives one letter for the TRILOGY word; or 2) if a player collects a wild symbol, such as a clown symbol 61 or a star symbol 63 or a wild "BINGO" letters symbol (i.e. not shown on the ticket 60), then that player receives one letter for the TRILOGY word. The player or players continue to purchase tickets 60 until they are able to obtain all of the TRILOGY letters. When a player or players obtains all of the TRILOGY letters, then the player or players call out "TRILOGY BINGO" or some other win notification in order to win the game 21B.

As an example, a player would sit at a table player station 72 of table 70 as shown in FIG. 12. The existence of the player may be identified and registered by the computer 92 or by the dealer depressing the corresponding player station button 78A for the respective player station 72. (In our FIG. 12 example, the computer 92 would identify and register the existence of player number four, or the dealer would depress the player station button 78A corresponding to player number four.) The player would request from the dealer the desired number of ticket(s) 60 to be purchased and played for a ticket dispensing round and purchase the ticket(s) 60 for the TB lottery ticket game 11B at the table 70 from the dealer. The dealer receives cash or chips from the player. The dealer places the cash into the cash drop box 75 and places the chips into the chip tray 73. The dealer depresses the respective player station button 78A for that player, and the dealer records the number of tickets 60 purchased by that player by activating a corresponding button 77 which inputs into the computer 92 the desired number of ticket(s) 60 to be dispensed for a particular player. The dispenser/reader 71 is then activated to read and dispense the respective number of ticket(s) 60 for that player. The dealer dispenses the respective number of ticket(s) 60 to that player. The dealer continues to receive cash or chips and dispense ticket(s) to each of the players in an orderly fashion (i.e. from the first player to the last player). If one of the table player stations 72 is not occupied by a player, then the computer 92 or dealer does not register that player number, and the dispenser/reader 71 and dealer would skip the dispensing of ticket(s) for that player station number.

A ticket 60 is dispensed from and read by the dispenser/reader 71. The computer 92 determines for which player that ticket 60 is being or has been dispensed, and the computer 92 receives information from the bar code 67 for that ticket. The player uses the ticket(s) 60 to play the TB lottery ticket game(s) 11B and wins or loses this game(s) 11B according to the manner described earlier in the specification. Since the information on the bar code 67 has been read from the ticket 60 to the computer 92, the computer 92 controls or instructs display of win information for the players for each ticket 60 on monitors, displays, or the table 70. The player determines whether elements 13B (i.e. BINGO letters 65 or wild symbols 61 and 63 or wild BINGO letters symbol) from the TB lottery ticket game(s) 11B exist on each of the ticket(s) 60 that are able to be used and played for the TB letters collection game 21B. If a player receives any element(s) 13B, then this element(s) 13B are used accordingly in the TB letters collection game 21B. The computer 92 having read the bar code information from the ticket 60 accordingly lights up any respective lights 80 and/or lights 82 depending on the elements 13B detected by the computer 92 for that ticket 60. For example, if a player receives one of the B-I-N-G-O letters 65, then the computer 92 lights up the respective B-I-N-G-O light 80 at the table player station 72. When the player has received all of the letters 65 to light up all of the respective B-I-N-G-O lights 80 at the table player station 72, then the table player station 72 lights up a next unlit TRILOGY indicator light 82 and resets all of the B-I-N-G-O lights 80 to an unlit condition. If the player were to receive multiples of the same letters before receiving the remaining BINGO letters, then the game 21B may be set up such that these multiples are not used at all or may be used after the BINGO indicator lights 80 have all been reset. Furthermore, if a player receives a wild symbol (i.e. clown symbol 61 or star symbol 63 or wild BINGO letters symbol), then the computer 92 directly lights up a next unlit TRILOGY indicator light 82 at the table player station 72 to show that the player has received the next TRILOGY letter. The player would start with receiving the letter "T", and the player continues to play and receive letters from the TB lottery ticket game 11B until he/she has received all of the TRILOGY letters to hopefully win the TB letters collection game 21B. Also, the TB letters collection game 21B may be set up such that if a player receives a clown symbol 61 or star symbol 63, then the computer 92 directly lights up a next unlit TRILOGY indicator light 82 at the table player station 72 to show that the player has received the next TRILOGY letter and the computer 92 does not reset the BINGO indicator lights 80 to show that the player may continue to play those BINGO letters that have already been collected. On the other hand, if a player receives a wild BINGO letters symbol, then the computer 92 lights up the remaining unlit BINGO indicator lights 80 and directly lights up a next unlit TRILOGY indicator light 82 at the table player station 72 to show that the player has received the next TRILOGY letter and the computer 92 then resets the BINGO indicator lights 80.

The present game 5C is played by one player among a number of other players. FIG. 11 shows that one player at a player station 72 is playing among other players at other player stations 72. The game 5C is able to be set up in a number of different embodiments. One embodiment is to simply have players play among each other at a table 70, and the players are playing against each other for a table progressive jackpot. In this embodiment, if a player wins the table progressive jackpot, then this table game 5C may be set up such that the table 70 resets wherein all the indicator lights for all of the player stations 72 are reset and all players start a new game with a new jackpot. Alternatively, this table game 5C may be set up such that only the winner's player station 72 and the jackpot are reset and all of the remaining players continue to play from the point where they left off to try to win the reset jackpot.

Another embodiment would expand the table game 5C to a house game 5C wherein a number of tables 70 within a house are linked together, and the players at various tables 70 are playing for a house progressive jackpot. In this embodiment, if a player wins the house progressive jackpot, then this house game 5C may be set up such that all of the tables 70 reset wherein all the indicator lights for all of the player stations 72 are reset and all players in the house start a new game with a new jackpot. Alternatively, this house game 5C may be set up such that only the winner's player station 72 at a particular table 70 and the house jackpot are reset and all of the remaining players at the various tables 70 continue to play from the point where they left off to try to win the reset jackpot.

Another alternative embodiment would expand the house game 5C game even further to a networked game 5C wherein a number of tables 70 from a number of houses are networked together, and the players at various tables 70 from various houses are playing for a networked progressive jackpot. In this embodiment, if a player wins the networked progressive jackpot, then this networked game 5C may be set up such that all of the tables 70 reset wherein all the indicator lights for all of the player stations 72 are reset and all players from all networked houses start a new game with a new jackpot. Alternatively, this networked game 5C may be set up such that only the winner's player station 72 at a particular table 70 at a particular house and the networked jackpot are reset and all of the remaining players at the various tables 70 at various houses continue to play from the point where they left off to try to win the reset jackpot.

Figure 13:
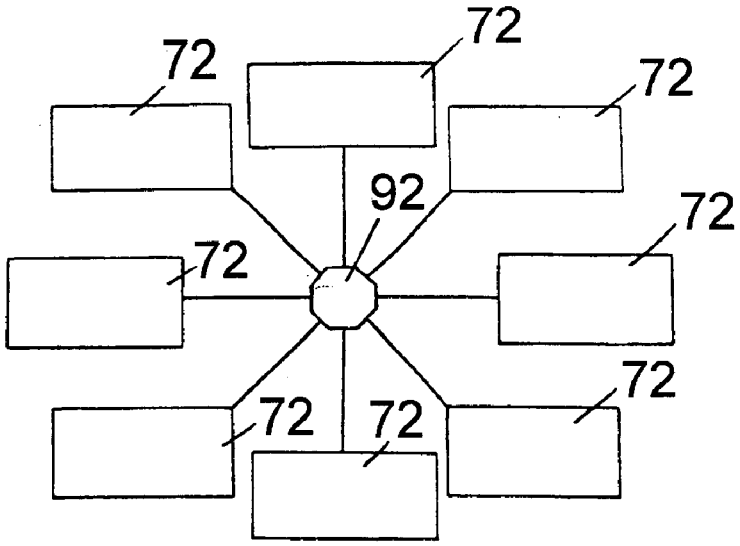
FIG. 13 is a top view diagram showing a number of player stations coupled to a central table computer.
Figure 14:
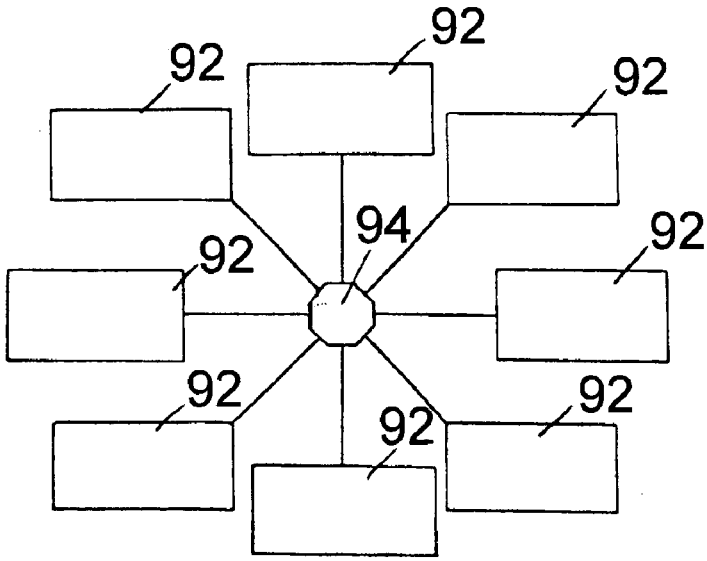
FIG. 14 is a top view diagram showing a number of table computers coupled to a central house computer.
Figure 15:
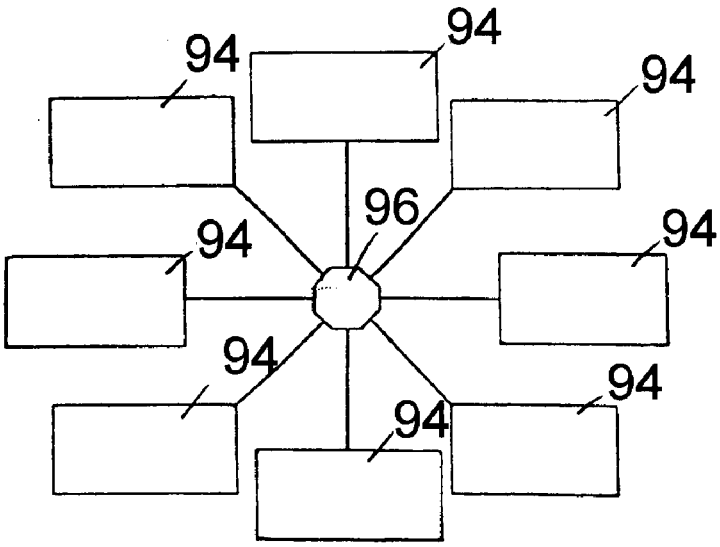
FIG. 15 is a top view diagram showing a number of house computer coupled to a central network computer.

For the table game embodiment, FIG. 13 shows that the computer 92 controls and regulates play of all of the players at player stations 72 who are playing among each other since the player stations 72 are all linked to the computer 92. For the house game embodiment, FIG. 14 shows that all of the computers 92 for all of the tables 70 in the house are coupled to a central house computer 94. The central house computer 94 controls and regulates play of all of the players at player stations 72 at various tables 70 within the house who are playing among each other. For the networked game embodiment, FIG. 15 shows that all of the house computers 94 are coupled to a central network computer 96. The central network computer 96 controls and regulates play of all of the players at player stations 72 at various houses who are playing among each other.

When a player receives all of the TRILOGY letters to win the jackpot for the TB letters collection game 21B, then the player must call out "TRILOGY BINGO" or some other win notification in order to win the game 21B. In the event that two or more players have simultaneously received all of the TRILOGY letters, then the game 5C may be set up such that the first player that has called out "TRILOGY BINGO" or the win notification is determined to be the sole winner of the jackpot for game 21B. Alternatively, the game 5C may be set up such that the players that have simultaneously received all of the TRILOGY letters are required to call out "TRILOGY BINGO" or the win notification before the next ticket dispensing round. Those players who have properly and timely called out "TRILOGY BINGO" or the win notification will win and split the jackpot for game 21B, and those players who did not call out "TRILOGY BINGO" or the win notification would not win anything.

After a player or players has called out a win of the TB letters collection game 21B, the dealer at the table(s) 70 for the respective player station(s) 72 activates a button 79 to communicate the win to the central computer 92, 94, or 96 depending on whether the game 5C is respectively a table, house, or networked embodiment. The computer 92, 94, or 96 records the winner identification, the time and date of win, jackpot amount, and other relevant player/win information. For the version in which game 5C resets in its entirety, the computer 92, 94, or 96 locks and resets all player stations 72 and the jackpot, and a new game 5C with a new jackpot begins. For the version in which game 5C only resets the winner's player station 72, the computer 92, 94, or 96 resets the jackpot but only locks and resets the winner's player station 72, and the game 5C continues for all remaining players to try and win the reset jackpot amount. Alternatively, the game 5C is able to be set up such that the computer 92, 94, or 96, depending on whether a table, house, or networked game is being implemented, automatically locks and resets accordingly when a player or players has been determined by computer 92, 94, or 96 to have received all of the TRILOGY letters.

An additional element to the game 5C is providing players that are playing among each other at a table 70 the opportunity to place wagers against each other. A player would be able to place a wager into a table wager jackpot as to whether he/she will receive certain game elements 13B in the next ticket dispensing round. For example, the game 5C may be set up such that the players wager that they will receive enough game elements 13B to light up one or more of the BINGO indicator lights 80 in the next ticket dispensing round. The player(s) that actually receive enough game elements 13B from the ticket dispensing round to light up one or more of the BINGO indicator lights 80 win/split the table wager jackpot. Chips may be provided to the players for making the table wagers. Therefore, referring to FIG. 7, the TB letters collection game 21B provides players with win opportunities 24B, which may be in the form of a letter jackpot game 25 and a table wager game 27.

The game 5C allows players to enter and leave a table player station 72 at a table 70 as they desire. When a player enters a table player station 72 at a table 70, at least the computer 92 identifies and registers the player as active at the player station 72 (i.e. a player station button 78A for the player is activated by the dealer or a player sensing mechanism is automatically activated at the player station 72 when a player arrives at the player station 72). When a player leaves the table 70, the computer 92 logs off that player from the game 5C and resets that player station 72 (i.e. player station button 78A for the player is deactivated by the dealer or player sensing mechanism is automatically deactivated at player station 72 when player leaves). The tracking of the players as they enter and leave the game 5C allows the computer 92, 94, or 96 to properly manage and oversee game play and also provides continuous, uninterrupted play for other players.

Figure 18:
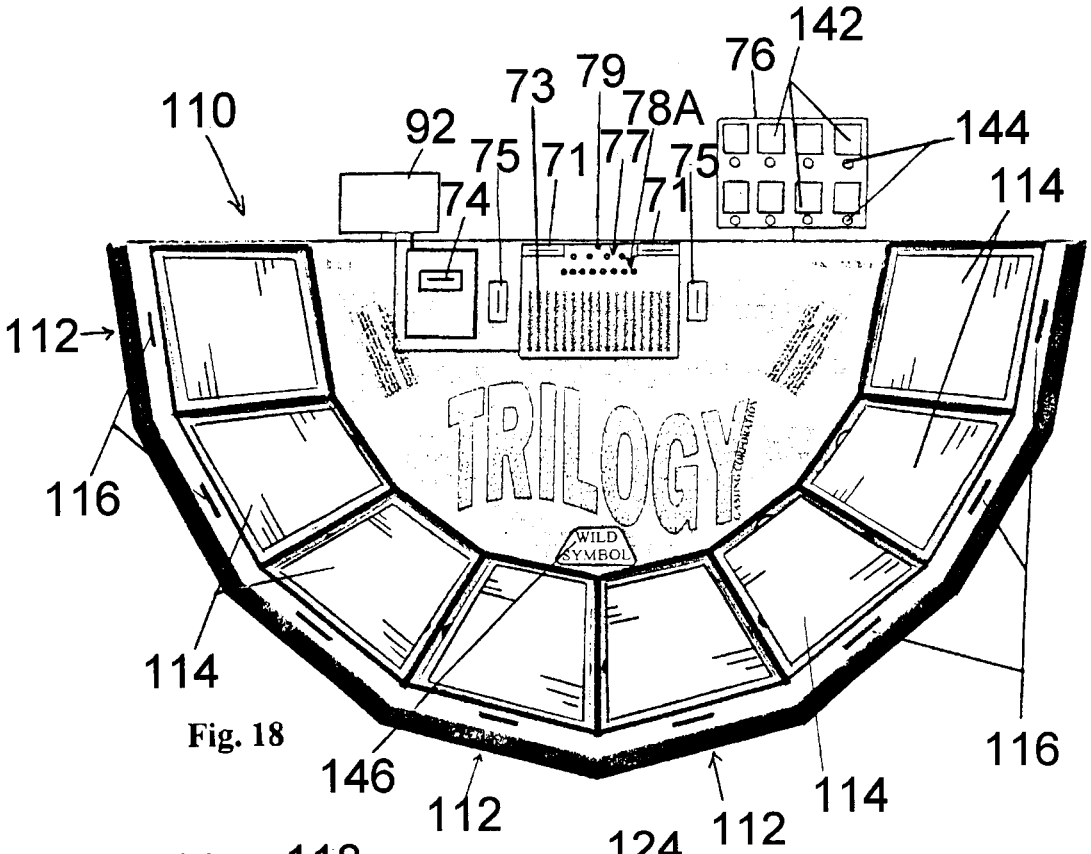
FIG. 18 is a top view of a second embodiment table for the present invention TRILOGY BINGO game.

Furthermore, FIG. 18 shows a second embodiment table 110 for the present invention TRILOGY BINGO game 5C. The table 110 is particularly used for playing the TB letters collection game 21B among a number of players. The table 110 comprises a number of player stations 112, a number of player station monitors 114, a number of player station ticket validation/win drop boxes 116, a ticket dispenser/reader 71, a dealer chip tray 73, a cash drop box 75, a dealer monitor 76, ticket purchase buttons 77, player station buttons 78A, and a win lock and reset button 79. Each player station 112 has a player station monitor 114. The table 110 is coupled to a computer 92 for controlling and monitoring play of the various players at the table 110. The player station monitor 114 provides an electronic display for play of the game 5C to each player. The dispenser/reader 71 dispenses each ticket 60 and reads the bar code 67 printed thereon. The dealer chip tray 73 holds and organizes the playing chips for that table 110. The cash drop box 75 holds monies received from the players. The ticket purchase buttons 77 are depressed by the dealer to dispense tickets for the players. The ticket purchase buttons 77 are configured in the same manner as described earlier. The player station buttons 78A are respectively depressed by the dealer to activate and deactivate player stations 112 for registering the player and dispensing tickets 60 for that player. The win lock and reset button 79 is depressed by the dealer when a win occurs to record a win and/or lock the system and to reset a winning player station 112 or all player stations 112 depending on how the game is configured. The dealer monitor 76 allows the dealer to view and monitor play at all player stations 112 and the overall game. Each player station 112 may also have a player station ticket validation/win drop box 116. The player station ticket validation/win drop box 116 receives and reads alleged winning tickets 60 from the respective player and validates and records the winning tickets 60 and invalidates the non-winning tickets 60. The player station ticket validation/win drop box 116 also communicates with the computer 92 to record and track total amounts won by a player at a player station 112.

Figure 19:
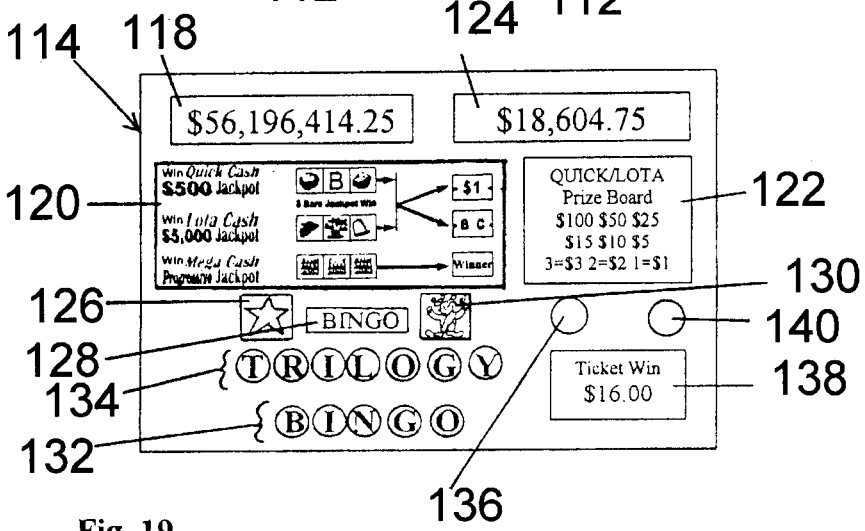
FIG. 19 is a top view of a game play monitor at a play station of the table in FIG. 18.

FIG. 19 shows a more detailed view of the play station monitor 114. The player station monitor 114 shows various game displays to the player while playing the TB lottery game 11B and the TB letters collection game 21B of game 5C. For playing the TB lottery game 11B, the player station monitor 114 shows the present value of the Mega Cash progressive jackpot amount in window 118, the ticket play area 120 for the Quick Cash, Lota Cash, and Mega Cash games, and the Quick Cash/Lota Prize Board display area 122. Furthermore, the player station monitor 114 also shows the present value of TB letters collection game progressive jackpot amount in window 124. The monitor 114 also has wild symbol displays, such as the star symbol display 126, wild BINGO letters display 128, and clown symbol display 130. The monitor 114 further displays the BINGO letters 132 and the TRILOGY letters 134. The monitor 114 also has a ticket win record button 136 and a ticket win total display 138 and a pay out/credit button 140. Referring back to FIG. 18, the dealer monitor 76 at least shows the win totals for each player station 112 at a display area 142. Also, the dealer monitor 76 has a respective win/clear button 144 for each player station 112 wherein the button 144 is depressed by the dealer when the player wishes to be paid out or credited with the total win amount shown in the display area 142.

The game 5C using table 110 is played in the same general manner as the game 5C using table 70. The ticket(s) 60 is/are dispensed to a player, and the ticket play area 120 of monitor 112 displays the play(s) of that ticket(s) 60. Winning amounts are calculated according to the defined prizes in the prize board display area 122. The amount of the Mega Cash jackpot continues to progress in the window 118 as players play the TB lottery ticket game 11B. If a player has received an alleged winning ticket 60, then the alleged winning ticket(s) 60 are read and validated by the respective player station ticket validation win drop box 116 and/or the ticket validation/win drop box(es) 74 (i.e. validated in the same manner by the drop box 74 as described earlier). If the alleged winning ticket(s) 60 is/are validated by the drop box 116, then the player inserts the ticket(s) 60 into the box 116 and depresses the ticket win record button 136. If the ticket(s) 60 is not a valid winning ticket, then the drop box 116 rejects the non-winning ticket(s) 60 or the drop box 116 takes the non-winning ticket(s) and does not record any winning amount(s). On the other hand, if the ticket(s) is a valid winning ticket, then the drop box 116 reads and records the information from the winning ticket(s) and communicates to the computer 92 to add the respective winning amount(s) from the winning ticket(s) 60 to the total win amount shown in display area 138 and the drop box 116 receives and holds the winning ticket(s) 60. The updated total win amount for each player is also reflected in display area 142 at the dealer monitor 76.

If a player at a player station 112 decides to receive a pay out of his/her total win amount shown in display area 138 and 142, then the player depresses the pay out/credit button 140. The computer 92 indicates to the dealer that the player wishes to receive his/her pay out. The dealer pays out the respective amount to the player in the form of cash, chips, credits, tickets, etc. and depresses the respective win/clear button for that player station 112 to clear the total win amount in the display areas 138 and 142. Therefore, in this embodiment, the computer 92 keeps track of the total win amounts for the players as they play a number of tickets 60 and/or a number of rounds of the TB lottery ticket game 11B and allows players to receive pay outs as they desire. The TB letters collection game 21B is played in the same manner as described earlier. The wild symbols 126, 128, and 130, the BINGO letters 132, and the TRILOGY letters 134 are displayed or lit in the similar manner as the wild symbol lights 86, 88, 89, the BINGO letters lights 80, and the TRILOGY letters lights 82 that were described earlier for table 70.

The dealer monitor 76 in FIG. 18 may also show the same images that are displayed in the player station monitors 114 for further monitoring of the player stations 112 and the overall play of the game 5C. Alternatively, the table 110 may be set up wherein the use of tickets 60 are eliminated and/or wherein the game 5C is played entirely electronically using the table 110. Also, a table jackpot may be implemented when using the table 110. The table jackpot play is the same type of play described earlier for table 70. In FIG. 18, the table jackpot play may be set up such that a wild symbol needs to be obtained from a ticket 60 in order to win the table jackpot. The table 110 has a wild symbol table jackpot display 146 that would be shown activated or lit if one or more players has received the respective wild symbol. The wild symbol may be the same star symbol 63, the same clown symbol 61, the same wild BINGO symbol, or an entirely different symbol.

Figure 16:
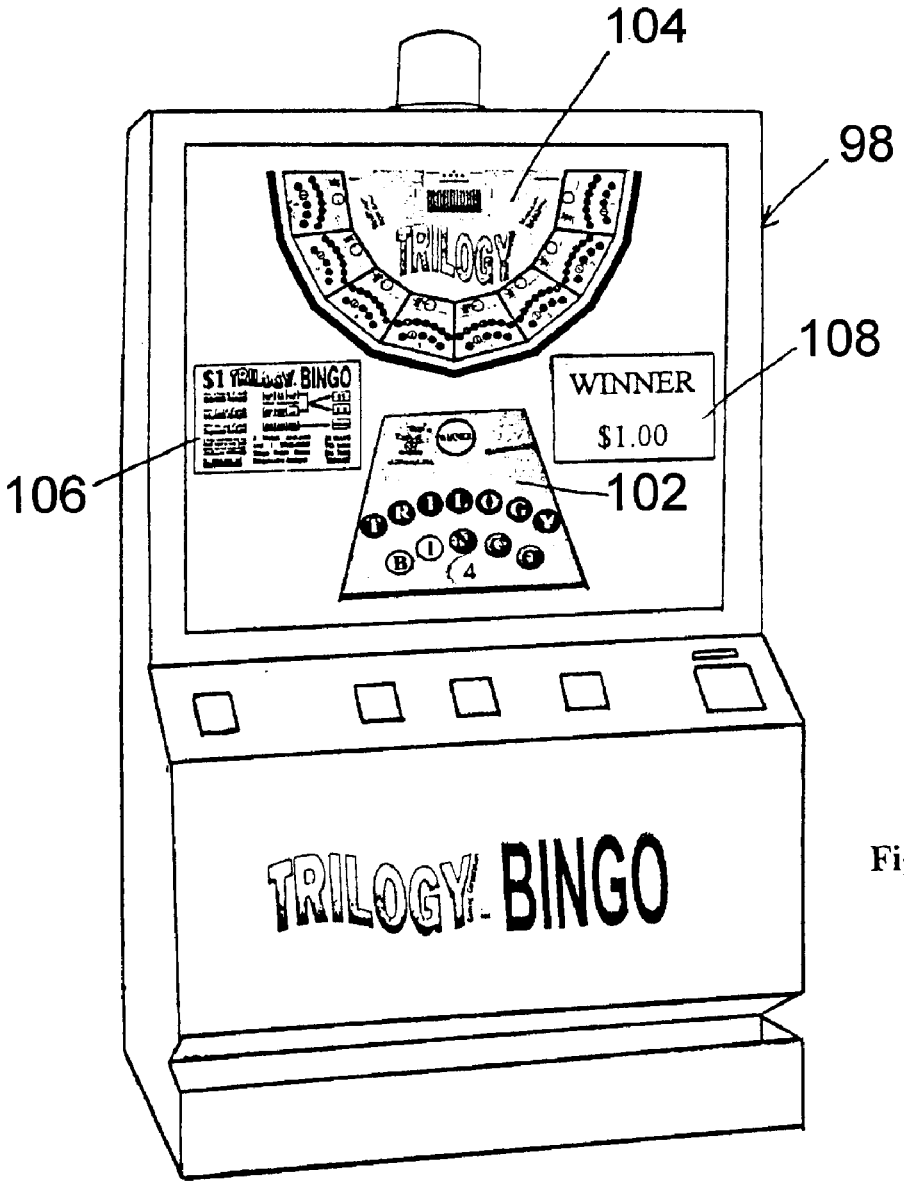
FIG. 16 is a front view of the electronic apparatus for the electronic version of the present invention TRILOGY BINGO game.
Figure 17:
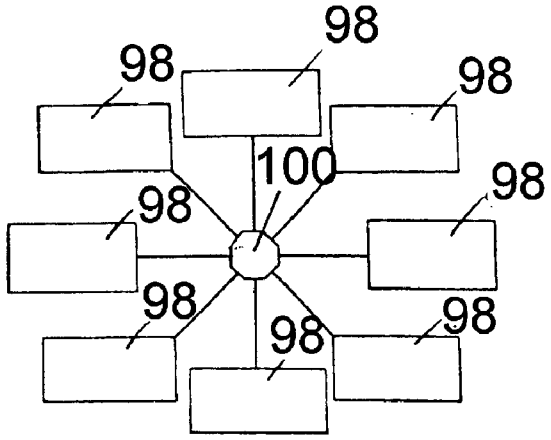
FIG. 17 is a top view diagram showing a number of electronic apparatuses according to FIG. 16 coupled together to a central computer.

Alternatively, the implementation of the above game 5C may be done on a fully electronic basis. FIG. 16 shows an electronic apparatus 98 wherein a player sits or stands in front of the apparatus 98. The apparatus 98 may use tickets 60, or, instead of using ticket(s) 60, player stations 72, and table(s) 70, a number of electronic apparatuses 98 are linked together to an electronic central computer 100 as shown in FIG. 17 to provide a fully electronic version of play of the game 5C. The electronic apparatus 98 electronically displays a ticket display 106 identical to an uncovered ticket(s) 60 for the play of game 11B instead of dispensing them and also displays the respective win(s), element(s) 13B, and other ticket information received from the ticket(s) 60. The electronic apparatus 98 also shows a display 102 identical to the player station 72 and may contain a view 104 of FIG. 16 of the other players among whom the player is playing at the other apparatuses 98 which are linked together or a view 114 of FIG. 19. The electronic apparatus 98 may also show a display or view 114 identical to the one shown in FIG. 19 and may contain all game play display, validation, and credit/win information and operations. The electronic apparatus 98 is able to show other relevant play and win information such as progressive jackpot win at additional display area 108. The game 5C is played in the same manner described earlier except that the players are located at respective electronic apparatuses 98 and the electronic central computer 100 fully controls, manages, and oversees play of the game 5C (i.e. dealers and tables are not used for the fully electronic version apparatus 98).

The preferred embodiment of the invention is described above in the Figures and Detailed Description. Unless specifically noted, it is the intention of the inventor that the words and phrases in the specification and claims be given the ordinary and accustomed meanings to those of ordinary skill in the applicable art(s). The foregoing description of a preferred embodiment and best mode of the invention known to applicant at the time of filing the application has been presented for the purposes of illustration and description. It is not intended to be exhaustive or to limit the invention to the precise form disclosed, and many modifications and variations are possible in the light of the above teaching. The embodiment was chosen and described in order to best explain the principles of the invention and its practical application and to enable others skilled in the art to best utilize the invention in various embodiments and with various modifications as are suited to the particular use contemplated. Also, the present invention is not in any way limited to the specific embodiments or configurations presented in this specification.

What is claimed is:

1. A method for playing one game and using elements from the one game to play at least another game, comprising the steps of:

defining rules and the elements for the one game, providing and using the elements for the one game, playing the one game, defining the rules for the at least another game, providing and using at least some of the elements from the one game to play the at least another game, playing the at least another game, wherein the one game is a lottery ticket game and the at least another game is a symbol collection game, wherein the lottery ticket game is further defined by the steps of:

defining symbols for the lottery ticket game, printing the symbols on lottery tickets for the lottery ticket game, using the symbols to define winning indices for the lottery tickets, wherein the symbol collection game is further defined by the steps of:

using and collecting at least some of the symbols from the lottery ticket game to play the symbol collection game, wherein the step of using and collecting at least some of the symbols for the lottery ticket game to play the symbol collection game further comprises the step of:

using and collecting BINGO letters and wild symbols by playing a play of the lottery ticket game, and wherein the symbol collection game further comprises the steps of:

collecting and spelling letters of TRILOGY, obtaining one of the letters of TRILOGY by collecting all of the BINGO letters from plays of the lottery ticket game, obtaining one of the letters of TRILOGY by obtaining one of the wild symbols from plays of the lottery ticket game, and winning a jackpot for the symbol collection game by collecting all of the letters of TRILOGY.

2. The method according to claim 1 wherein the winning step further comprises the step of:

calling out a win notification when a player has collected all of the letters of TRILOGY.

3. The method according to claim 2 wherein the calling step further comprises the step of:

determining a sole winner of a jackpot when all of the letters of TRILOGY have been collected by the player and the player first calls out the win notification.

4. The method according to claim 2 wherein the calling step further comprises the step of:

determining winners of a jackpot when all of the letters of TRILOGY have been collected by a number of players after a play of the lottery ticket game and the players have appropriately called out the win notification after the play of the respective lottery ticket game.

5. The method according to claim 1 wherein the jackpot is a progressive jackpot.

6. The method according to claim 5 wherein the progressive jackpot is determined based on sales of the lottery tickets from the lottery ticket game.

7. The method according to claim 1 further comprising the step of:

wagering for a table jackpot among other players as to certain BINGO letters being collected after a play of the lottery ticket game.

8. The method according to claim 1 wherein the wild symbol is a clown symbol.

9. The method according to claim 1 wherein the wild symbol is a star symbol.

10. The method according to claim 1 wherein the wild symbol is a wild letters symbol for a word that provides all remaining letters of the word.

11. The method according to claim 1 wherein the method is played electronically in entirety.

12. A method for playing one game and using elements from the one game to play at least another game, comprising the steps of:

using symbols as the elements to define wins for the one game, providing and using the symbols to play the one game, playing the one game, using at least some of the symbols from the one game to play the at least another game, playing the at least another game, wherein the one game is a lottery ticket game and the at least another game is a symbol collection game, wherein the lottery ticket game is further defined by the steps of:

printing the symbols on lottery tickets for the lottery ticket game, using the symbols to define wins for the lottery tickets, and wherein the symbol collection game is further defined by the steps of:

using and collecting at least some of the symbols from the lottery ticket game to play the symbol collection game, wherein the step of using and collecting at least some of the symbols for the lottery ticket game to play the symbol collection game further comprises the step of:

using and collecting BINGO letters and wild symbols by playing a play of the lottery ticket game, and wherein the symbol collection game further comprises the steps of:

collecting and spelling letters of TRILOGY, obtaining one of the letters of TRILOGY by collecting all of the BINGO letters from plays of the lottery ticket game, obtaining one of the letters of TRILOGY by obtaining one of the wild symbols from plays of the lottery ticket game, and winning a jackpot for the symbol collection game by collecting all of the letters of TRILOGY.

13. The method according to claim 12 wherein the winning step further comprises the step of:

calling out a win notification when a player has collected all of the letters of TRILOGY.

14. The method according to claim 1 wherein the step of using the symbols to define wins for the lottery tickets further comprises the step of:

defining appearances of various combinations of the symbols on the lottery tickets as various win possibilities for various win amounts.

15. The method according to claim 12 wherein the method is played electronically in entirety.

16. A lottery ticket game and letters collection game comprising:

lottery tickets having defined play symbols wherein the defined play symbols include at least symbols to be collected for the letters collection game, various winning combinations of the play symbols printed for the lottery ticket game, and at least one letters collection combination obtained from the symbols that is defined as at least one winning situation for the letters collection game, wherein the various winning combinations include at least a combination of BINGO letters, wherein the at one winning situation is a collection of all letters for TRILOGY wherein one of the letters for TRILOGY is obtained and collected when all letters for BINGO have been collected from at least one of the lottery tickets and wherein on of the letters for TRILOGY is obtained and collected when a wild symbol has been collected from at least one of the lottery tickets.

17. The lottery ticket game and letters collection game according to claim 16 further comprising:

a table having a plurality of table player stations wherein the table player stations each have indicator lights to light up respective symbol images as the symbols are collected from the lottery tickets.

18. The lottery ticket game and letters collection game according to claim 17 wherein the table player stations are linked together to at least one table computer wherein the at least one table computer controls and manages play of the games for the table.

19. The lottery ticket game and letters collection game according to claim 17 wherein the table further comprises:

a dispenser and reader for dispensing the lottery tickets and reading bar codes on the lottery tickets.

20. The lottery ticket game and letters collection game according to claim 17 wherein the table further comprises:

a dealer chip tray for holding and organizing playing chips for the table.

21. The lottery ticket game and letters collection game according to claim 17 wherein the table further comprises:

at least one ticket validation and win drop box for receiving and reading the lottery tickets that are alleged winning tickets and validating and recording winning tickets and invalidating non-winning tickets.

22. The lottery ticket game and letters collection game according to claim 21 wherein the at least one ticket validation and win drop box is placed at a dealer station.

23. The lottery ticket game and letters collection game according to claim 21 wherein the at least one ticket validation and win drop box is placed at each of the table player stations and at least one ticket win record button is located at each of the table player stations that is depressed by a player who has inserted at least one ticket into the at least one ticket validation and win drop box to validate the at least one ticket.

24. The lottery ticket game and letters collection game according to claim 17 wherein the table further comprises:

a cash drop box for receiving and holding monies received from players.

25. The lottery ticket game and letters collection game according to claim 17 wherein the table further comprises:

at least one ticket purchase button to dispense a predetermined number of tickets at a time for a single depression.

26. The lottery ticket game and letters collection game according to claim 17 wherein the table further comprises:

a plurality of player station buttons that are depressed by a dealer to activate and deactivate the respective player stations.

27. The lottery ticket game and letters collection game according to claim 17 wherein the table further comprises:

a win and lock reset button that is depressed by a dealer when a win occurs to at least record the win and at least reset the player station at which the win occurred.

28. The lottery ticket game and letters collection game according to claim 17 wherein the table further comprises:

a dealer monitor that allows a dealer to view and monitor play of the player stations and overall game play.

29. The lottery ticket game and letters collection game according to claim 28 wherein the dealer monitor displays same images displayed at each of the player stations.

30. The lottery ticket game and letters collection game according to claim 28 wherein the dealer monitor displays lottery ticket total win amounts for each of the player stations.

31. The lottery ticket game and letters collection game according to claim 30 wherein the dealer monitor further comprises:

a win and clear button for each of the player stations wherein the win and clear button is depressed when a player wish to be paid out a respective lottery ticket total win amount.

32. The lottery ticket game and letters collection game according to claim 17 wherein each of the table player stations further comprises:

a play station monitor for displaying various game displays to a player while playing the game.

33. The lottery ticket game and letters collection game according to claim 32 wherein the play station monitor at least displays lottery ticket total win amount for a respective player.

34. The lottery ticket game and letters collection game according to claim 33 further comprising:

a pay out button located near the play station monitor that is depressed by the respective player to receive pay out of the lottery ticket total win amount.

35. The lottery ticket game and letters collection game according to claim 18 wherein the at least one table computer is a plurality of table computers in a house and the plurality of table computers are linked together to at least one house computer wherein the at least one house computer controls and manages play of the games within the house.

36. The lottery ticket game and letters collection game according to claim 35 wherein the at least one house computer is a plurality of house computers that are linked together in a network and the plurality of house computers are linked together to at least one network computer wherein the at least one network computer controls and manages play of the games within the network.

* * * * *